US010946234B2

(12) United States Patent
Starominsky

(10) Patent No.: US 10,946,234 B2
(45) Date of Patent: Mar. 16, 2021

(54) HAND GRIP FOR TRANSMITTING STRESS THROUGH A HAND STRAP TO A WRIST STRAP

(71) Applicant: Dimitry Starominsky, Charlotte, NC (US)

(72) Inventor: Dimitry Starominsky, Charlotte, NC (US)

( * ) Notice: Subject to any disclaimer, the term of this patent is extended or adjusted under 35 U.S.C. 154(b) by 3 days.

(21) Appl. No.: 16/163,213

(22) Filed: Oct. 17, 2018

(65) Prior Publication Data

US 2020/0121975 A1 Apr. 23, 2020

(51) Int. Cl.

| | |
|---|---|
| ***A63B 21/00*** | (2006.01) |
| ***A63B 21/06*** | (2006.01) |
| ***A41D 19/015*** | (2006.01) |

(52) U.S. Cl.

CPC .... *A63B 21/4021* (2015.10); *A41D 19/01547* (2013.01); *A63B 21/06* (2013.01); *A63B 21/4019* (2015.10); *A63B 2209/10* (2013.01)

(58) Field of Classification Search

CPC . A63B 21/4019; A63B 21/4021; A63B 71/14; A63B 71/141; A63B 71/143; A63B 71/145; A63B 71/146; A63B 71/148; A63B 21/06; A63B 21/065; A63B 21/068; A41D 19/0034; A41D 19/0037; A41D 19/0041; A41D 19/01547; A41D 19/01558; A41D 19/01564; A41D 19/01582; A41D 19/01588

See application file for complete search history.

(56) References Cited

U.S. PATENT DOCUMENTS

| | | | | |
|---|---|---|---|---|
| 1,333,792 A * | 3/1920 | Bunnell | A41D 13/082 294/25 |
| 4,400,831 A | 8/1983 | Rietz | |
| 4,720,279 A * | 1/1988 | Fritschen | B63B 34/63 441/69 |

(Continued)

OTHER PUBLICATIONS

Woodpeckers, 3/8 × 36 Inch Square Dowel Rods [online], Published Feb. 24, 2016, Retrieved from the Internet <URL: https://www.amazon.com/Square-Dowel-Rods-Unfinished-Woodpeckers/dp/B01C65O07A/ref=sr_1_1_sspa?keywords=square+dowel+rods&qid=158%E2%80%A6>. (Year: 2016).*

(Continued)

*Primary Examiner* — Andrew S Lo
*Assistant Examiner* — Zachary T Moore
(74) *Attorney, Agent, or Firm* — Tillman Wright, PLLC; James D. Wright; David R. Higgins

(57) ABSTRACT

A hand grip for transmitting tensile stress through a hand strap from an object, such as the bar of a barbell, being gripped to the wrist of the wearer without stressing the hand of the wearer, and extending around the bar of the barbell between the bar and the palm of the wearer. A block of relatively firm material is secured to and projects from the hand grip in a position to be engaged by the fingers of the wearer to lessen the possibility of the hand grip opening to release the bar of the barbell. The block has a flat front and a outer surfaces forming an edge for engagement under the knuckle of at least one finger of the hand of the wearer, and the front surface projects from the hand strap sufficiently to avoid lessening the grasp of the block by the fingers of the wearer.

19 Claims, 6 Drawing Sheets

(56) References Cited

U.S. PATENT DOCUMENTS

| | | | | | |
|---|---|---|---|---|---|
| 4,793,005 | A * | 12/1988 | Hetzel, Jr. | A41D 19/01547 | 2/161.1 |
| 5,298,001 | A * | 3/1994 | Goodson | A63B 21/4021 | 2/161.1 |
| 5,353,440 | A * | 10/1994 | Meldeau | A41D 19/01547 | 2/161.1 |
| 5,898,944 | A | 5/1999 | Vrany | | |
| 6,666,795 | B2 * | 12/2003 | Mah | A63B 21/4019 | 2/161.1 |
| 6,849,036 | B2 * | 2/2005 | Forslid | A63B 21/4021 | 482/139 |
| 7,051,377 | B1 | 5/2006 | Milner | | |
| 9,339,693 | B1 | 5/2016 | Pegram | | |

OTHER PUBLICATIONS www.powergrabs.com website dated 2017, particularly the first three sections submitted herewith, and the videos assessable by opening the website.
Power Grabs advertisement sheet, attached.

* cited by examiner

HAND GRIP FOR TRANSMITTING STRESS THROUGH A HAND STRAP TO A WRIST STRAP

FIELD OF THE INVENTION

The present invention relates to hand grips that are used to transmit the tensile stress of lifting or pulling loads through a hand strap to a wrist strap without stressing the hand of the wearer.

BACKGROUND OF THE INVENTION

When hands are used to lift or pull objects, tensile stress is created in the muscles of the fingers and hands as well as in the arms, legs and core muscles. As the muscles of the fingers and hands are not as large and therefore not as strong as the muscles of the arms, legs and core, the muscles of the hands limit the amount of force that can be applied for lifting and pulling. In particular, in weightlifting gymnastic exercises and in competition using barbells, the amount of weight that can be lifted is limited by the strength of the fingers and hands.

As a result, handgrips and gloves have been devised that bypass the fingers and hands in the application of stress by connecting directly the tensile stress created by the lifting to the wrists without involving the fingers and hands. Typical handgrips and gloves of this type have wrist straps secured to the wrists of the wearer and flexible hand straps secured to the wrist straps and extending outwardly and flexed around the bar of a barbell and under the fingers and palm of the hand of the wearer. With this construction, as long as the fingers and palm of the wearer maintain closure of the flexible hand strap around the bar, the tensile stress of lifting the barbell is transmitted through the hand strap to the wrist strap without stressing the fingers and hand of the wearer.

To avoid slippage or disengagement of the outer portion of the flexible hand strap sufficient to result in the fingers and hands being subjected to the tensile stress of lifting, some handgrips and gloves incorporate small dowels in the outer portions of the hand strap forming small protuberances located for engagement by the fingertips of the wearer or over which the fingers extend to enhance resistance to movement of the outer portion of the hand strap.

SUMMARY OF THE INVENTION

The present invention provides a stronger and more reliable way of maintaining the hand strap in stress transferring position. This is accomplished by securing a firm, elongated block to the hand strap outer portion. The block projects outwardly across the outer portion and has a flat front surface and a flat outer surface forming an edge for engagement under the knuckle of the distal phalanx of at least one finger of the wearer. Thereby, providing for firm bent finger engagement of the block edge to prevent unwanted release of the outer portion out of stress transferring position. The known hand grips and gloves do not disclose or suggest this block edge engagement that provides firm and maintained stress transferring positioning of the hand strap.

Preferably, the front surface of the block extends normal to the hand strap outer portion, and the outer surface of the block extends normal to the front surface, thereby defining a distinctive edge for engagement by the distal phalanx at the knuckle. Also, preferably, the edge extends across the outer portion of the block at an inclination aligned with the inclination of the distal phalanx knuckles of at least two fingers crossed of the hand of the wearer.

In the preferred embodiment, the block is of sufficient upstanding extent to prevent engagement by the distal phalanx of the fingers with the outer portion of the hand strap sufficient to lessen the gripping of the block by the fingers, and the block is secured to the outer surface of the outer portion of the hand grip by a cover layer secured to the outer surface of the and extending over the block to secure the block to the outer portion.

Usually, these hand grips are provided in pairs, one hand adapted for the right hand and the other hand grip adapted for the left-hand. The primary difference being that the inclination of the block for the right hand is aligned with the inclination of the distal phalanx knuckles of the middle two fingers of the right hand of the wearer, and the block for the left-hand is aligned with the inclination of the distal phalanx knuckles of the middle two fingers of the left hand of the wearer.

DETAILED DESCRIPTION OF THE PREFERRED EMBODIMENT

Figure 1:
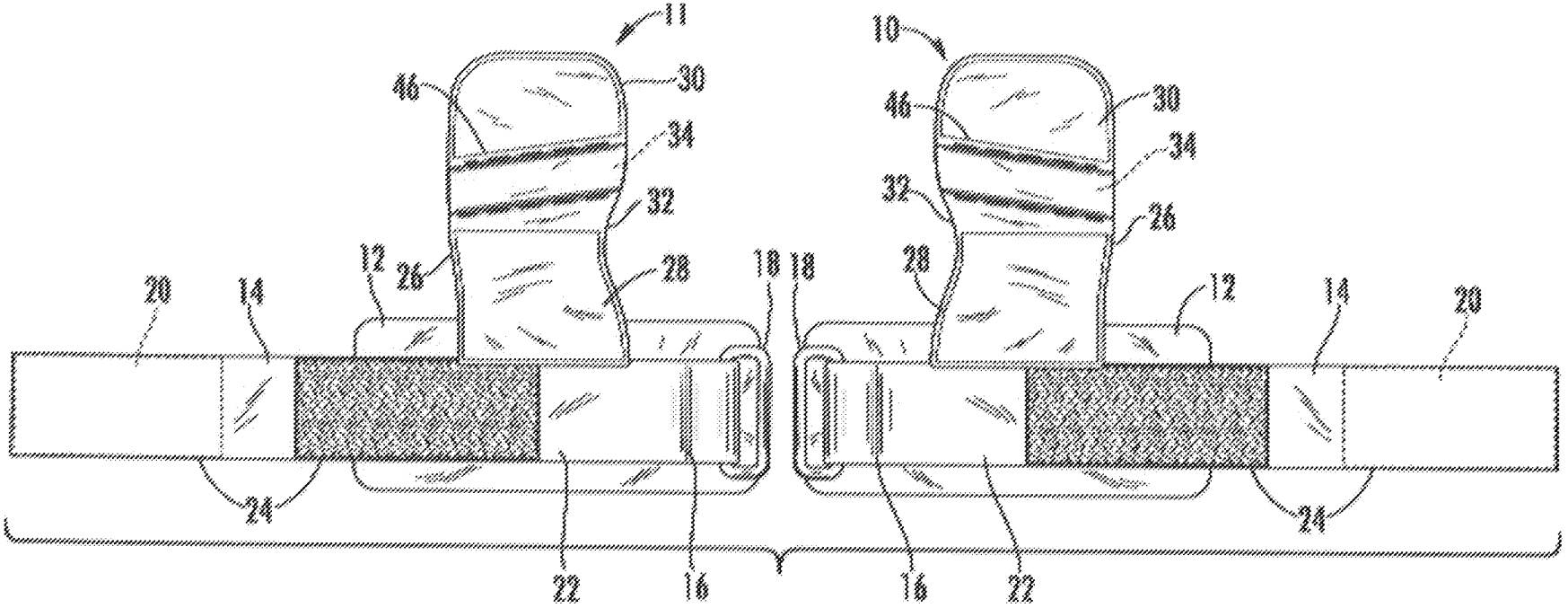
FIG. 1 is a plan view of a pair of hand grips opened up.
Figure 2:
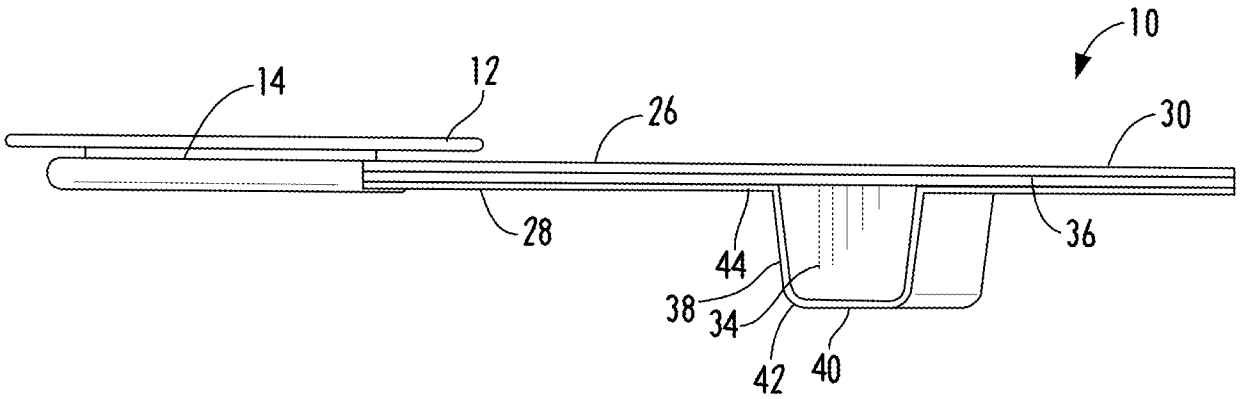
FIG. 2 is a side view of the hand grip at the left of FIG. 1 as viewed from the right of FIG. 1.

The preferred embodiment of the present invention is illustrated in the accompanying drawings. It consists of a pair of hand grips, one hand grip 10 for the left hand of the wearer, as illustrated at the left of FIG. 1, and the other hand grip 11 for the right hand of the wearer, as illustrated at right of FIG. 1. The two hand grips, 10 and 11, are identical mirror images of each other and the identical elements of the two are identified by the same reference numbers. The pair is adapted for use in performing gymnastic weight lifting with both hands.

Each hand grip 10 and 11 includes a flexible wrist strap 12 that wraps around the wrist W of a wearer and is secured tightly by an elongated band 14 that has an inner portion 16 secured in a metal ring 18 that is attached to the outside of the wrist strap 12. The outer portion 22 of the band 14 extends away from the ring 18 and around the wrist strap 12 to the ring 18, and is looped through the ring 18 and back along the inner portion 16 to tighten the wrist strap 12 around the wrist W of the wearer. The outer end 20 of the band 14 overlaps and is releasably secured to the inner portion 22 of the band 14 by hook and loop fastener patches 24 on the facing sides of the outer portion 22 and the inner portion 16.

A flexible double layer hand strap 26 has an inner portion 28 secured by stitching to the wrist strap 12, and extends outwardly therefrom, for facing the palm P and fingers F of the hand H of the wearer. The hand strap 26 is generally rectangular with an indentation 32 located to avoid interference with the base of the thumb of the wearer. The hand strap 26 has an outer portion 30 extending for flexing under the tips T of the fingers F and palm P of the hand H of the wearer and around the bar B of a barbell.

With this construction, when the hand grip 10 grasps the bar B of a barbell and lifts the barbell, the weight of the barbell is transmitted directly through the hand strap 14 to the wrist strap 12 without stressing the fingers F and hand H of the wearer. The only effort that is applied by the fingers F and hand H of the wearer is that necessary to maintain the outer portion 30 flexed around the barbell bar B.

The hand grip described up to this point is conventional. The present invention, as will be described, is a unique addition to this conventional hand grip that provides new, beneficial results in maintaining the hand grip in grasping position around the barbell bar with little effort.

An elongated block 34 of firm material, such as rubber or a suitable plastic foam material, is secured to and upstanding from the finger-facing surface 36 of the hand strap outer portion 30, and extends across the outer portion 30 in a position for engagement under the fingers F of the wearer to maintain the outer portion 30 of the hand strap 26 in position for transmitting the stress of lifting through the hand strap 26 to the wrist strap 12.

The block 34 has a flat front surface 38 extending normal to the hand strap outer portion 30, and a flat outer surface 40 extending normal to the front surface 38 to form an approximately right angle edge 42 with the front surface 38. The edge 42 of the block 34 is positioned for extending under the knuckle K of the distal phalanx D of at least one finger F that is bendable over the edge 42 to provide a firm grasp of the block 34 to prevent release of the outer portion 30 of the hand strap 30 and thereby maintain the hand strap 26 in stress transmitting position.

To enhance the engagement of the fingers F of the wearer to maintain the hand strap 26 against release, the block 34 extends at an inclination across the outer portion 30, with the inclination aligned with the inclination of the distal phalanx knuckles K of at least two fingers F he of the hand H of the wearer, preferably the two middle fingers MF of the hand H of the wearer.

The block 34 is secured to the outer portion 30 of the hand strap 26 by a cover layer 44 that extends over the block 34 and is secured by stitching 46 to the outer surface of the outer portion 30 of the hand strap 26 adjacent the outer edges of the hand strap 26 in both directions from the block 34, and including stitching closely adjacent and along the opposite inner edges of the block 34.

The front surface 38 of the block 34 extends away from the outer portion 30 of the hand strap 26 a sufficient upstanding extent to avoid limiting the bending of the fingers F about the edge 42 of the block 34 that would lessen the grasp of the block 34 by the fingers F of the wearer.

Figure 3:
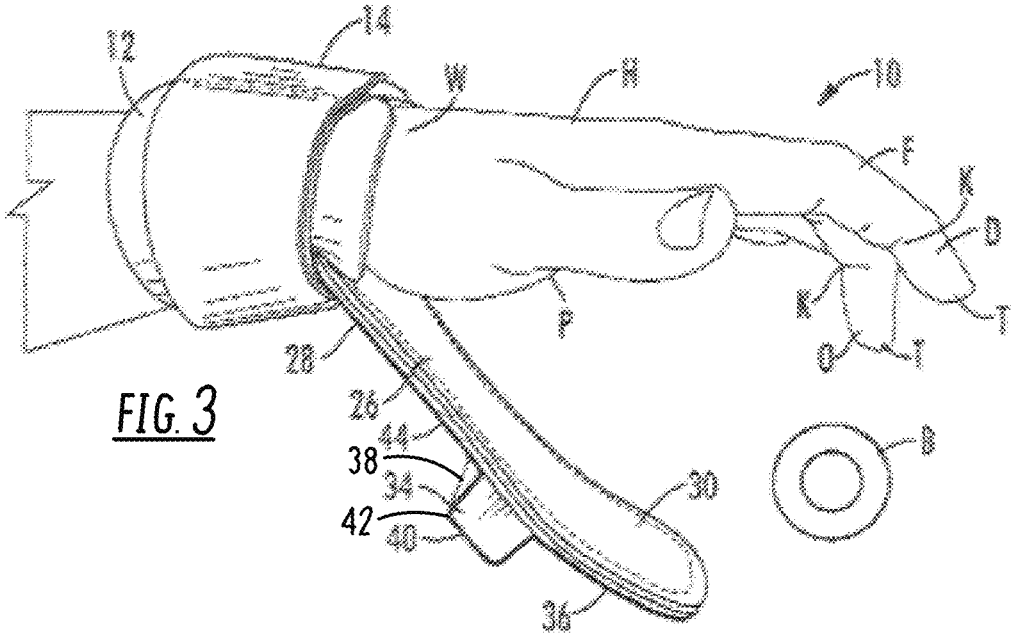
FIG. 3 is a perspective view of the hand grip at the left of FIG. 1 showing the hand grip attached to the wrist of a wearer and the hand strap open in preparation for grasping the bar of a barbell.
Figure 4:
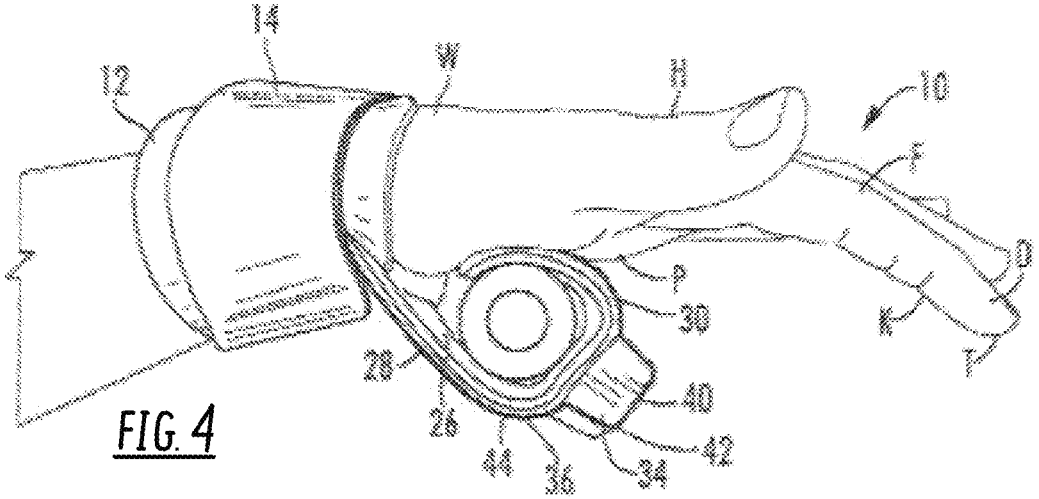
FIG. 4 is a perspective view similar to FIG. 3 showing the hand strap outer portion wrapped around the bar and against the palm of the wearer.
Figure 5:
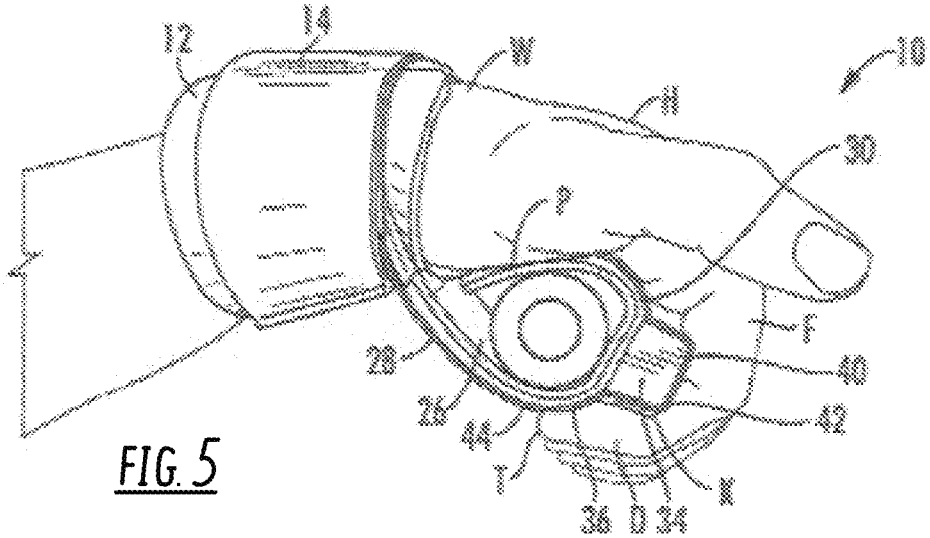
FIG. 5 is a perspective view similar to FIG. 4 showing the hand of the wearer engaging the block mounted on the hand strap.
Figure 6:
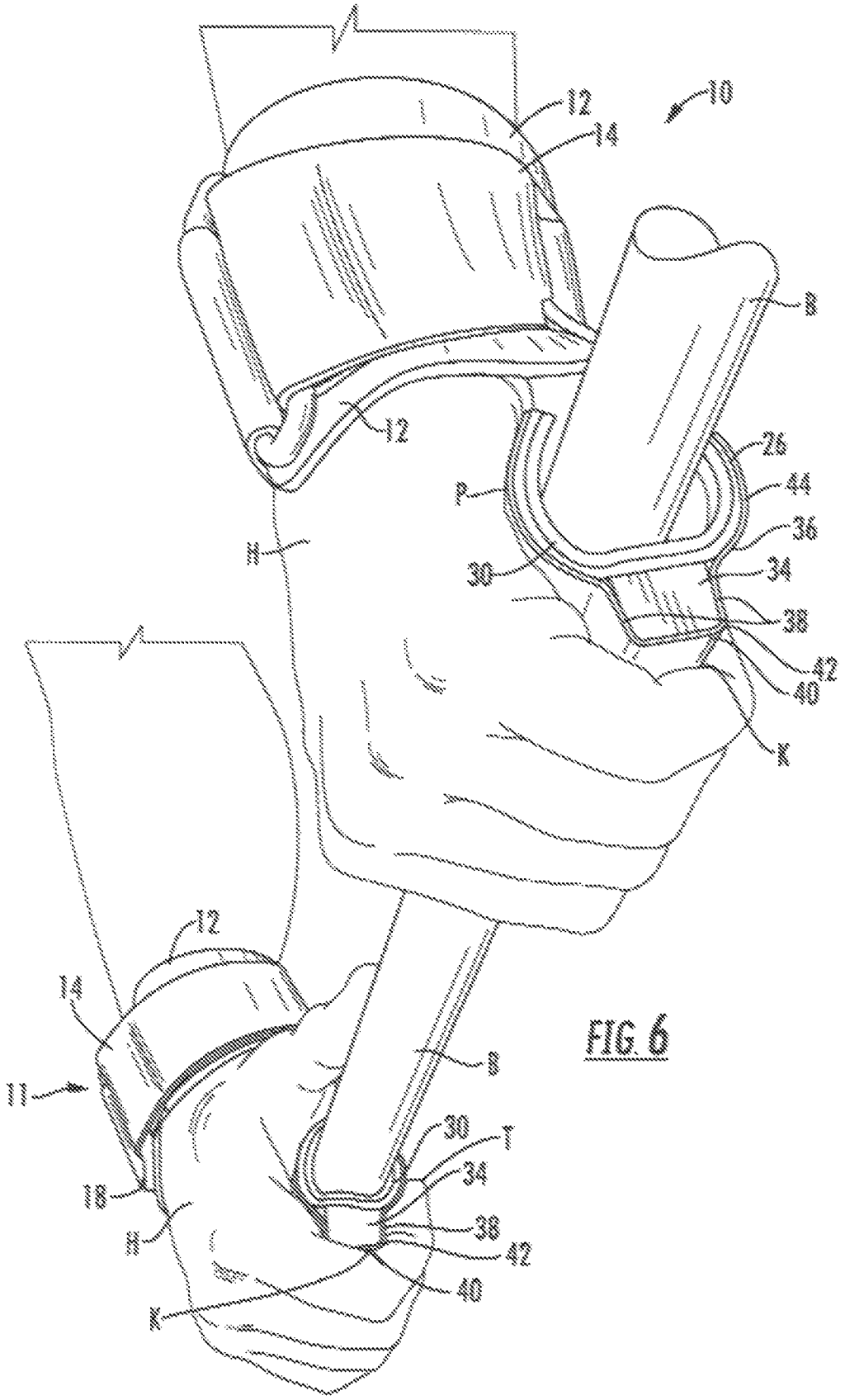
FIG. 6 is a perspective view of the two hands of a wearer with the hand grips attached to the wrists of the wearer and the hands and hand grips grabbing the bar of a barbell.
Figure 7:
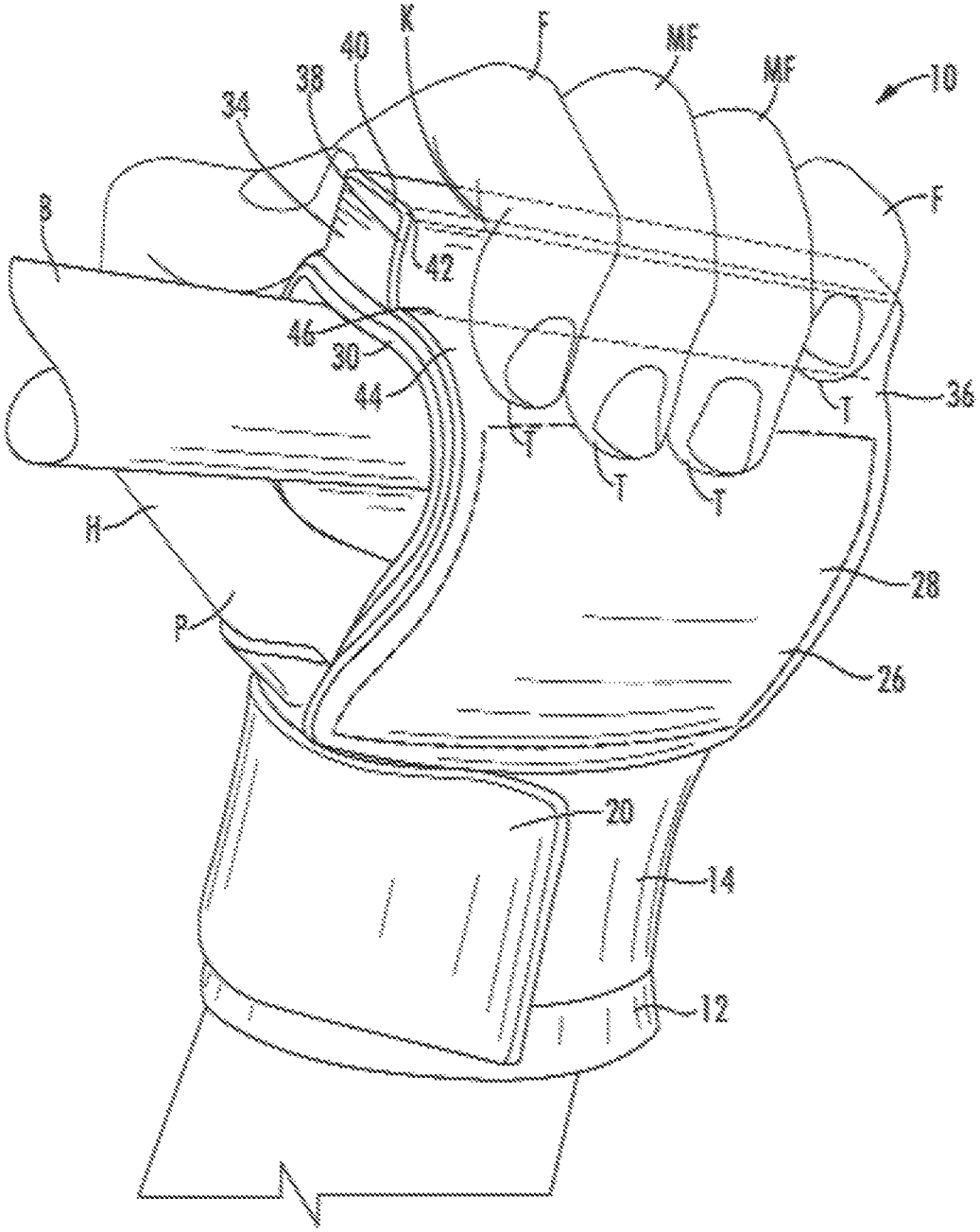
FIG. 7 is an enlarged perspective view of the left hand and attached hand grip illustrated at the right of FIG. 6 and looking at an angle toward the underside of the hand and hand grip.
Figure 8:
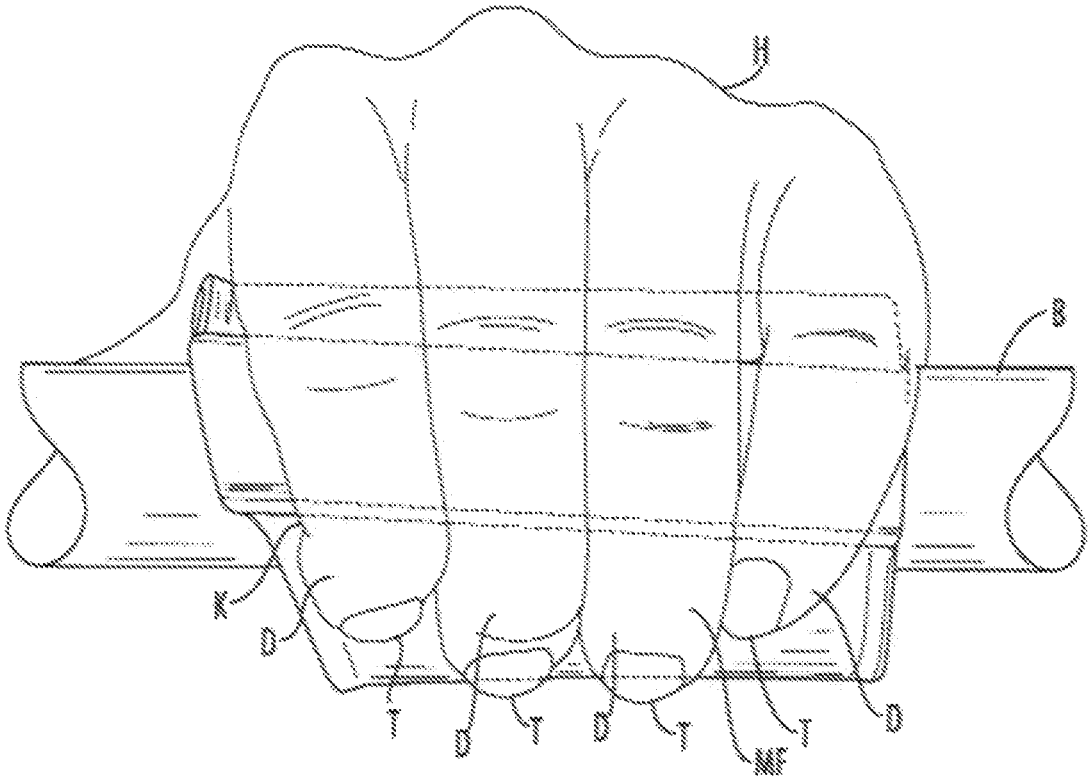
FIG. 8 is an enlarged end view of the left hand and attached hand grip illustrated at the right of FIG. 6.

In use, the handgrips 10, 11 are applied to the bar B of a barbell as illustrated in FIGS. 3, 4, and 5, which illustrate the left hand grip 10. The wrist strap 12 is first attached to the wrist of the wearer with the hand strap 26 extending from the wrist strap 12, with the hand strap 26 facing the palm and fingers F (FIG. 3). The outer portion 30 of the hand strap 26 is then wrapped around the bar B of the barbell with the outer portion 30 extending between the palm P of the wearer (FIG. 4). The hand H is then closed around the outer portion 30 of the hand strap 26, with the fingers F of the hand H grabbing the block 34 with the knuckles K of the distal phalanxes D engaging the edge 42 of the outer portion 30 of the hand strap 26. The distal phalanxes D of the fingers F extend from the edge 42 toward and touching the adjacent surface of the outer portion 30, but this touching is not sufficient to lessen the necessary grabbing of the edge 42 by the distal phalanxes D to maintain the hand strap 62 from disengaging the bar B (FIGS. 5, 6, 7, and 8).

In a present embodiment, the wrist strap 12 is made of flexible foam rubber. The band 14 is made of leather or plastic. The hand strap 26 is made of two layers, one of leather and the other of foam rubber. The block 34 is made of rigid foam rubber. It is long and square in cross-section, each side being about ¾ of an inch wide. It is inclined approximately 10 degrees from horizontal.

In view of the foregoing written description and drawings of the present invention, it will be readily understood by those skilled in the art that the present invention is susceptible of broad utility and application in many embodiments and adaptations of the present invention other than herein described. Many variations and modifications will be apparent from or reasonably suggested by the foregoing description without departing from the substance or scope of the present invention. Accordingly, while the present invention has been described herein in detail in relation to a present embodiment, it is to be understood that this disclosure is only illustrative of examples of the present invention and is made merely for purposes of providing a full and enabling disclosure of the invention. The foregoing disclosure is not intended nor is it to be construed to limit the present invention or otherwise exclude any other embodiment, adaptations, variations, modifications, and equivalent arrangements. The present invention is limited only by the scope of the claims appended hereto and equivalents again thereof.

What is claimed is:

1. A hand grip for transmitting tensile stress through a hand strap from an object being gripped to the wrist of a wearer without stressing the hand of the wearer, comprising:

a wrist strap configured to be releasably secured around the wrist of the wearer;

a hand strap secured to said wrist strap and having a flexible outer portion with a free end that is extendable over the object, with the object between the hand strap and the fingers and palm of the wearer, and then under at least the fingers and palm of the wearer, with the free end between the object and the palm, for transmitting stress between the object and the wrist of the wearer, without stressing the hand of the wearer; and a firm elongated block secured to and upstanding from said hand strap outer portion and extending across said outer portion configured for engagement under the fingers of the wearer to maintain said outer portion in position for transmitting stress;

said block having a flat front surface and a flat outer surface forming an edge with said front surface, said edge extending across said outer portion configured for engagement under the knuckle of the distal phalanx of at least one finger of the wearer, and with the distal phalanx of said at least one finger being bendable over said edge to grasp said block to prevent release of said outer portion and said hand strap from stress transmitting position.

2. A hand grip according to claim 1, wherein said front surface extends normal to said hand strap outer portion, and said outer surface extends normal to said front surface.

3. A hand grip according to claim 1, wherein said edge extends across said outer portion at an inclination aligned with an inclination of the distal phalanx knuckles of at least two fingers of the hand of the wearer.

4. A hand grip according to claim 3, wherein said at least two fingers are two middle fingers of the hand of the wearer.

5. A hand grip according to claim 3, wherein said hand grip is a pair of hand grips, wherein said edge of said block of one of said hand grips is configured to be inclined for engagement by the knuckles of two middle fingers of a left hand of the wearer, and wherein said edge of said block of the other of said pair of hand grips is configured to be inclined for engagement by the knuckles of two middle fingers of a right hand of the wearer.

6. A hand grip according to claim 1, wherein a cover layer is secured to said outer portion and extends over said block to secure said block to said outer portion.

7. A hand grip according to claim 1, wherein said front surface is of sufficient upstanding extent to avoid limiting the bending of the fingers of the wearer about said edge of said block that would lessen the grasp of said block by the fingers of the wearer.

8. A hand grip for transmitting tensile stress through a hand strap from an object being gripped to the wrist of a wearer without stressing the hand of the wearer, comprising:

a wrist strap configured to be releasably secured around the wrist of the wearer;

a hand strap secured to said wrist strap and having an inner portion and a flexible outer portion, wherein a free end of the outer portion is extendable over the object, with the object between the hand strap and the fingers and palm of the wearer, and then under at least the fingers and palm of the wearer, with the free end between the object and the palm, for transmitting stress between the object and the wrist of the wearer, without stressing the hand of the wearer; and a firm elongated block secured to and upstanding from said hand strap outer portion and extending across said outer portion configured for engagement under the fingers of the wearer to maintain said outer portion in position for transmitting stress;

said block being disposed partway along the hand strap, at a distal end of the inner portion thereof, such that a distal segment of the flexible outer portion of the wrist hand strap extends beyond the block and is configured to extend between the object and lower portions of the fingers of the wearer; and said block having a flat front surface that extends normal to said hand strap inner portion and a flat outer surface forming an edge with said front surface, said edge extending across said outer portion configured for engagement under at least one finger of the wearer, and with at least one phalanx of said at least one finger being bendable over said edge to grasp said block to prevent release of said outer portion and said hand strap from stress transmitting position.

9. A hand grip according to claim 8, wherein said front surface extends normal to said hand strap outer portion, and said outer surface extends normal to said front surface.

10. A hand grip according to claim 8, wherein said edge extends across said outer portion at an inclination aligned with an inclination of the distal phalanx knuckles of at least two fingers of the hand of the wearer.

11. A hand grip according to claim 10, wherein said at least two fingers are two middle fingers of the hand of the wearer.

12. A hand grip according to claim 8, wherein a cover layer is secured to said outer portion and extends over said block to secure said block to said outer portion.

13. A hand grip according to claim 8, wherein said front surface is of sufficient upstanding extent to avoid limiting the bending of the fingers of the wearer about said edge of said block that would lessen the grasp of said block by the fingers of the wearer.

14. A hand grip for transmitting tensile stress through a hand strap from an object being gripped to the wrist of a wearer without stressing the hand of the wearer, comprising:

a wrist strap configured to be releasably secured around the wrist of the wearer;

a hand strap secured to said wrist strap and having a flexible outer portion with a free end that is extendable over the object, with the object between the hand strap and the fingers and palm of the wearer, and then under at least the fingers and palm of the wearer, with the free end between the object and the palm, for transmitting stress between the object and the wrist of the wearer, without stressing the hand of the wearer, wherein the outer portion includes first and second opposed surfaces, the first surface configured to face toward the object and the second surface configured to face away from the object when the outer portion is extended over the object with the object between the hand strap and the fingers and palm of the wearer; and a firm elongated block secured to and upstanding from the second, away-facing surface of said hand strap outer portion and extending across said outer portion configured for engagement under the fingers of the wearer to maintain said outer portion in position for transmitting stress;

said block having a flat front surface and a flat outer surface forming an edge with said front surface, said edge extending across said outer portion configured for engagement under at least one finger of the wearer, and with at least one phalanx of said at least one finger being bendable over said edge to grasp said block to prevent release of said outer portion and said hand strap from stress transmitting position.

15. A hand grip according to claim 14, wherein said front surface extends normal to said hand strap outer portion, and said outer surface extends normal to said front surface.

16. A hand grip according to claim 14, wherein said edge extends across said outer portion at an inclination aligned with an inclination of the distal phalanx knuckles of at least two fingers of the hand of the wearer.

17. A hand grip according to claim 16, wherein said at least two fingers are two middle fingers of the hand of the wearer.

18. A hand grip according to claim 14, wherein a cover layer is secured to said outer portion and extends over said block to secure said block to said outer portion.

19. A hand grip according to claim 14, wherein said front surface is of sufficient upstanding extent to avoid limiting the bending of the fingers of the wearer about said edge of said block that would lessen the grasp of said block by the fingers of the wearer.

* * * * *